US011130657B2

(12) United States Patent
Formosa

(10) Patent No.: US 11,130,657 B2
(45) Date of Patent: Sep. 28, 2021

(54) APPARATUS FOR ADJUSTING AN ORIENTATION OF A SUSPENDED LOAD

(71) Applicant: Joel Formosa, Courtenay (CA)

(72) Inventor: Joel Formosa, Courtenay (CA)

( * ) Notice: Subject to any disclaimer, the term of this patent is extended or adjusted under 35 U.S.C. 154(b) by 97 days.

(21) Appl. No.: 16/653,285

(22) Filed: Oct. 15, 2019

(65) Prior Publication Data

US 2020/0307964 A1 Oct. 1, 2020

(30) Foreign Application Priority Data

Mar. 29, 2019 (CA) ..... CA 3038447

(51) Int. Cl.
*B66C 13/08* (2006.01)
*B66C 1/12* (2006.01)

(52) U.S. Cl.
CPC ..... *B66C 13/08* (2013.01); *B66C 1/12* (2013.01)

(58) Field of Classification Search
CPC ..... B66C 13/08; B66C 1/12; B66C 1/10
See application file for complete search history.

(56) References Cited

U.S. PATENT DOCUMENTS 3,191,983 A * 6/1965 Gaglione ..... B66C 1/10 294/81.3
3,596,968 A * 8/1971 Holm ..... B66C 13/08 294/81.3
3,722,170 A * 3/1973 Jones ..... B66C 17/06 52/745.2
5,617,964 A 4/1997 Lücking et al.
8,000,835 B2 8/2011 Friz et al.
2001/0019692 A1* 9/2001 Ehrat ..... B25J 9/0051 414/735
2011/0100145 A1* 5/2011 Feng ..... B25J 9/0051 74/490.01
2015/0110582 A1* 4/2015 Jacobsen ..... B63B 27/10 414/141.6
2018/0222727 A1* 8/2018 Manchester ..... B66C 13/08

* cited by examiner

*Primary Examiner* — Stephen A Vu
(74) *Attorney, Agent, or Firm* — Finch & Maloney, PLLC; Michael J. Bujold; Jay S. Franklin

(57) ABSTRACT

An apparatus for adjusting an orientation of a suspended load. The apparatus includes a frame suspended from a suspension assembly. The suspension assembly has a first pivot axis enabling up and down pitching movement of the frame relative to the suspension assembly and a second pivot axis enabling up and down rolling movement of the frame relative to the suspending assembly. A first actuator extends between the suspension assembly and the frame. When the first actuator expands, a first end goes down and a second end goes up. When the first actuator contracts, the first end goes up and the second end goes down. A second actuator extends between the suspension and the frame. When the second actuator expands, a first side goes down and a second side goes up. When the second actuator contracts, the first side goes up and the second side goes down.

4 Claims, 6 Drawing Sheets

APPARATUS FOR ADJUSTING AN ORIENTATION OF A SUSPENDED LOAD

FIELD

There is described an apparatus that is used to adjust an orientation of a suspended load.

BACKGROUND

It is preferred that a suspended load be lifted along it's center of gravity. U.S. Pat. No. 8,000,835 (Friz et al) titled "Center of Gravity Sensing and Adjusting Load Bar, Program, Product and related methods" proposes a method and apparatus which has been developed by Lockheed Martin Corporation for use in safely lifting and stabilizing aircraft modules.

SUMMARY

There is provided an apparatus for adjusting an orientation of a suspended load. The apparatus includes a frame having a plurality of cable attachment points, whereby multiple cables from a suspended load are attached to the frame. The frame has a first end and a second end opposed to the first end. The frame has a first side and a second side opposed to the first side. The frame is suspended from a suspension assembly. The suspension assembly has a first pivot axis enabling up and down pitching movement of the frame relative to the suspension assembly and a second pivot axis enabling up and down rolling movement of the frame relative to the suspending assembly. A first actuator extends between the suspension assembly and the frame to impart a pitching movement of the frame. The first actuator expands and contracts. When the first actuator expands, the first end goes down and the second end goes up. When the first actuator contracts, the first end goes up and the second end goes down. A second actuator extends between the suspension and the frame to impart a rolling movement of the frame. The second actuator expands and contracts. When the second actuator expands, the first side goes down and the second side goes up. When the second actuator contracts, the first side goes up and the second side goes down.

The present invention was developed for the installation of modular homes. Unlike the Fris et al patent, there are times when there are advantages in bringing a modular home down in an orientation that is not level and then easing it down into place. As will hereinafter be further explained, it is easier to place a second modular home in close parallel side by side relation to a first modular home if a remote side edge of the second modular home which is remote from the first modular home is placed down first and then a proximate side edge of the second modular home that is closer to the first modular home is lowered into place. The apparatus, as described, enables the suspended load to be intentionally place in a desired orientation.

BRIEF DESCRIPTION OF THE DRAWINGS

These and other features will become more apparent from the following description in which reference is made to the appended drawings, the drawings are for the purpose of illustration only and are not intended to be in any way limiting, wherein.

DETAILED DESCRIPTION

Figure 1:
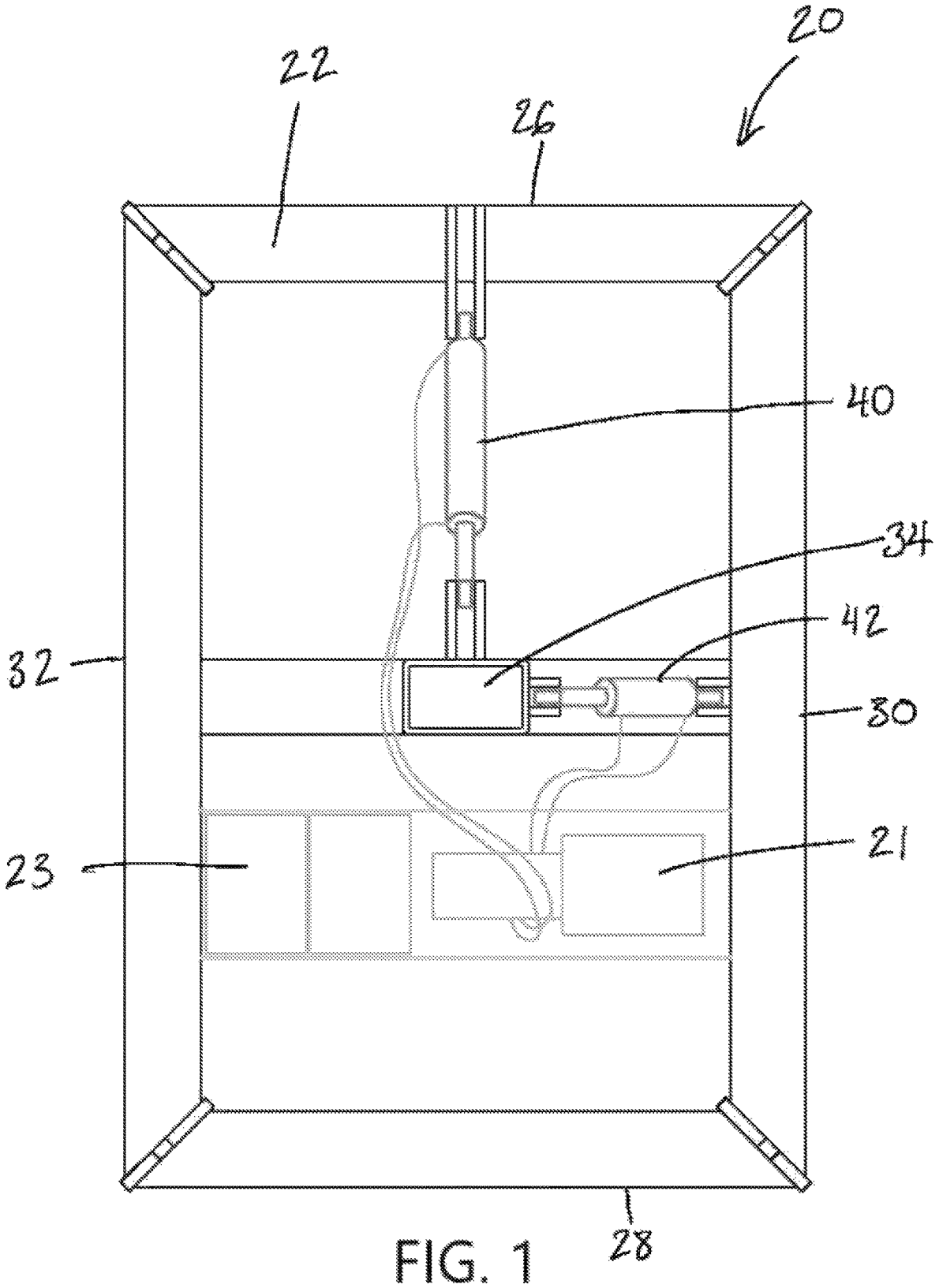
FIG. 1 is a top plan view of an apparatus for adjusting an orientation of a suspended load.

An apparatus for adjusting an orientation of a suspended load, generally identified by reference numeral 20, will now be described with reference to FIG. 1 through FIG. 11.

Structure and Relationship of Parts:

Referring to FIG. 1, apparatus 20 consists of a rectangular frame 22 having a first end 26 and a second end 28 opposed to first end 26. Frame 22 also has a first side 30 and a second side 32 opposed to first side 30. Referring to FIG. 2 through 7, frame 22 has a plurality of cable attachment points 24, which are shown as reinforced plates having apertures. Referring to FIG. 8 through 11, cable attachment points 24 allow multiple cables 27 to be attached to frame 22 from which a load 25 is suspended.

Figure 2:
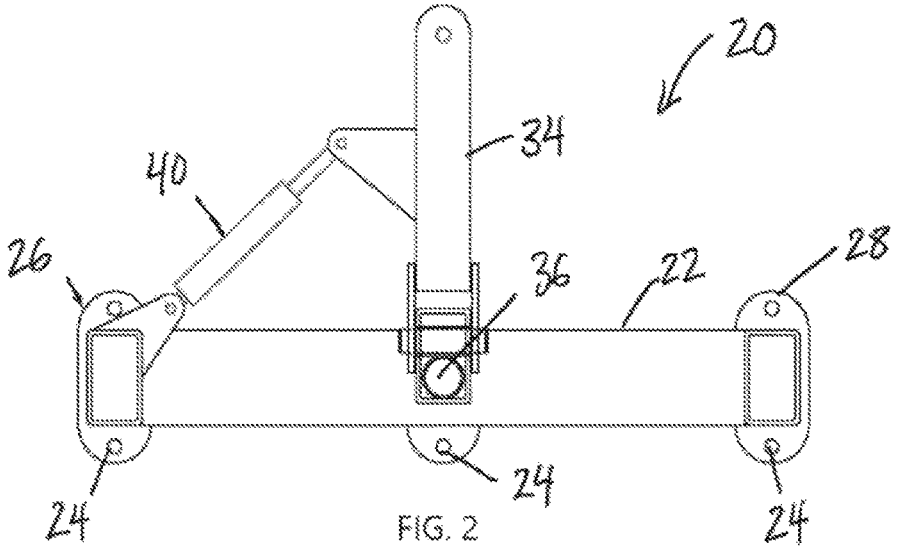
FIG. 2 is a first side elevation view of the apparatus of FIG. 1, in a level orientation.
Figure 3:
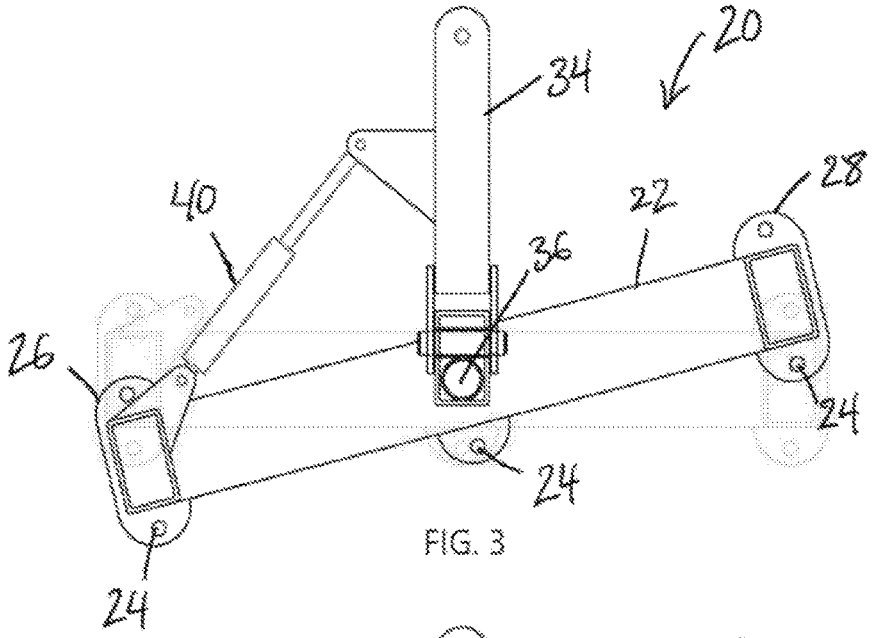
FIG. 3 is a second side elevation view of the apparatus of FIG. 1, with first actuator expanded to push first end down in a pitching movement, thereby raising second end up.
Figure 4:
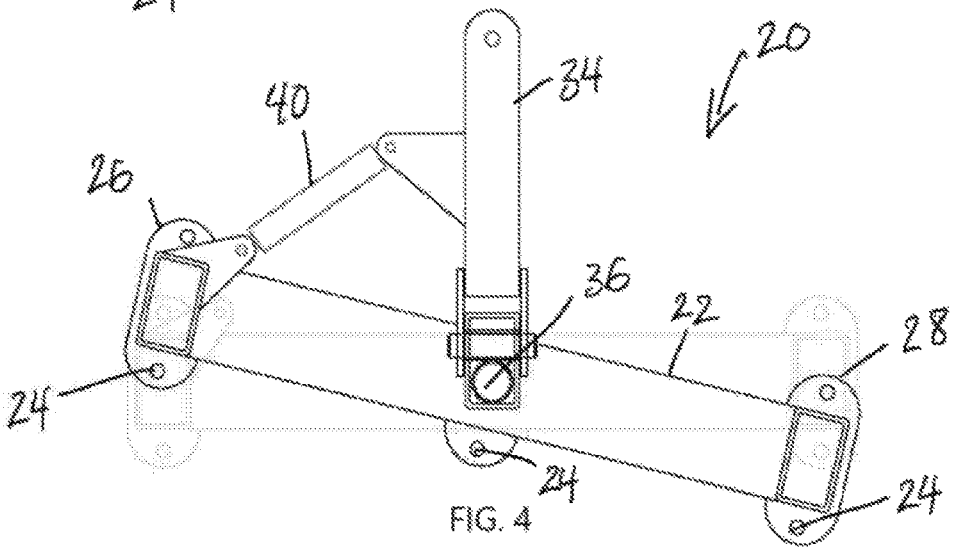
FIG. 4 is a third side elevation view of the apparatus of FIG. 1, with first actuator contracted to pull first end up in a pitching movement, thereby lowering second end down.

Referring to FIG. 2, apparatus 20 has a suspension assembly 34 from which frame 22 is suspended. Suspension assembly 34 has a first pivot axis 36 that enables up and down pitching movement of frame 22 relative to suspension assembly 34. A fluid activated first actuator 40 extends between suspension assembly 34 and frame 22 to impart a pitching movement of the frame 22 when first actuator 40 expands and contracts. Referring to FIG. 3, when first actuator 40 expands, first end 26 goes down and second end 28 goes up. Referring to FIG. 4, when first actuator 40 contracts, first end 26 goes up and second end 28 goes down. Referring to FIG. 1, attached to frame 22 is a hydraulic pump 21 and a hydraulic fluid reservoir 23. Hydraulic pump 21 draws hydraulic fluid from hydraulic reservoir 23 to activate first actuator 40.

Figure 5:
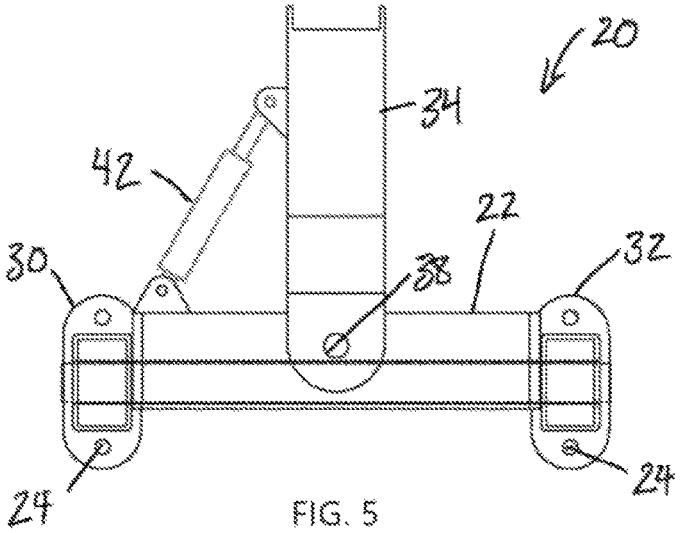
FIG. 5 is a first end elevation view of the apparatus of FIG. 1, in a level orientation.
Figure 6:
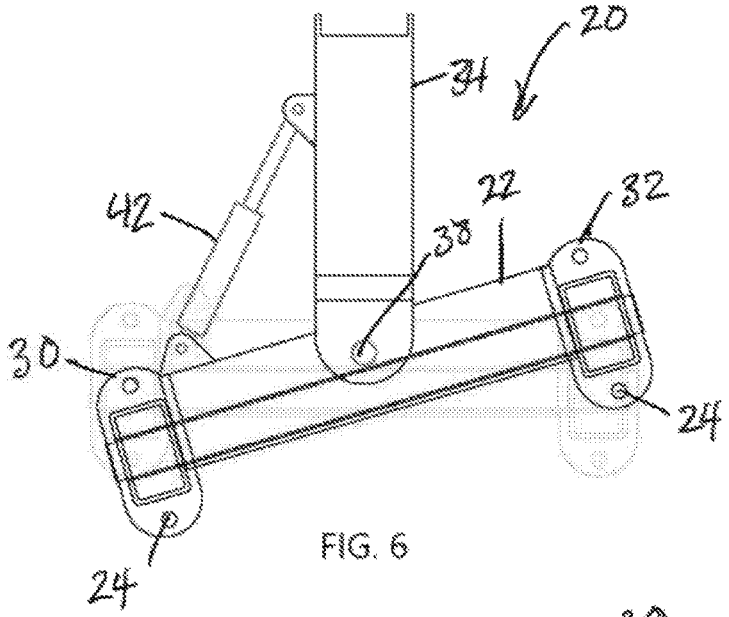
FIG. 6 is a second end elevation view of the apparatus of FIG. 1, with first actuator expanded to push first side down in a rolling movement, thereby raising second end up.
Figure 7:
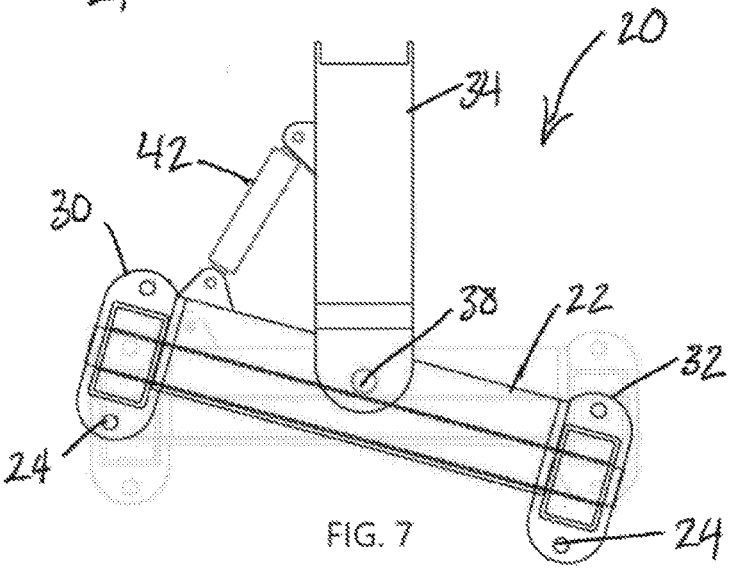
FIG. 7 is a third end elevation view of the apparatus of FIG. 1, with first actuator contracted to pull first end up in a rolling movement, thereby lowering second end down.

Referring to FIG. 5, suspension assembly 34 has a second pivot axis 38 enabling up and down rolling movement of frame 22 relative to suspension assembly 34. A fluid activated second actuator 42 extends between suspension assembly 34 and frame 22 to impart a rolling movement of frame 22 as second actuator 42 expands and contracts. Referring to FIG. 6, when second actuator 42 expands, first side 30 goes down and second side 32 goes up. Referring to FIG. 7, when second actuator 42 contracts, first side 30 goes up and second side 32 goes down. Referring to FIG. 1, attached to frame 22 is a hydraulic pump 21 and a hydraulic fluid reservoir 23. Hydraulic pump 21 draws hydraulic fluid from hydraulic reservoir 23 to activate second actuator 42.

Figure 8:
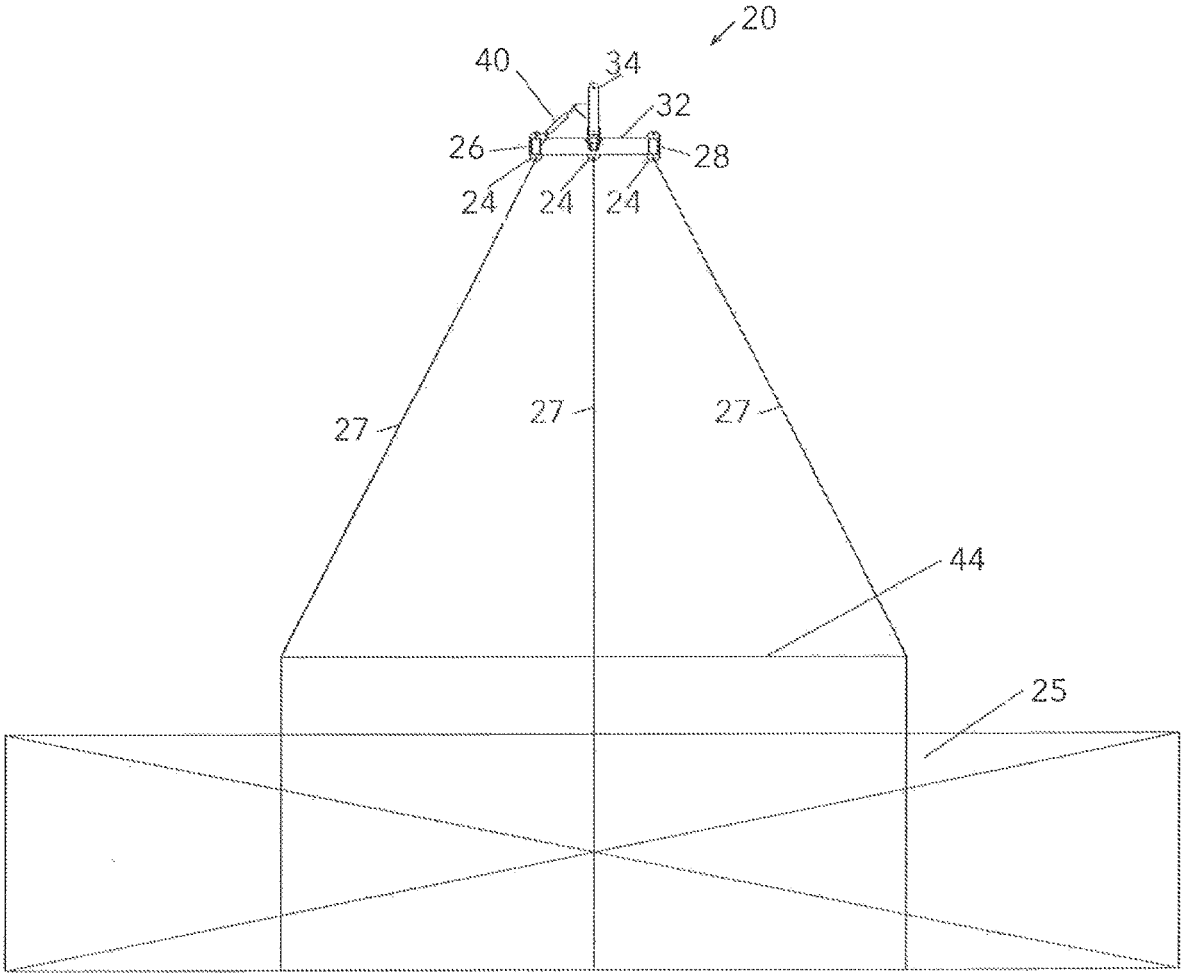
FIG. 8 is a first side elevation view of the apparatus of FIG. 1 with suspended load, in a neutral orientation.

Operation:

Referring to FIG. 8, cables 27, which are used to suspend a load 25, are connected to connection points 24 of frame 22 (connections points being shown in FIG. 2 through FIG. 7.) Load 25, as illustrated, is a modular home. A modular home has been chosen for illustration, as a modular home was a load that apparatus 20 was developed to handle. A spreader bar 44 is generally used to spread cables 27.

Figure 9:
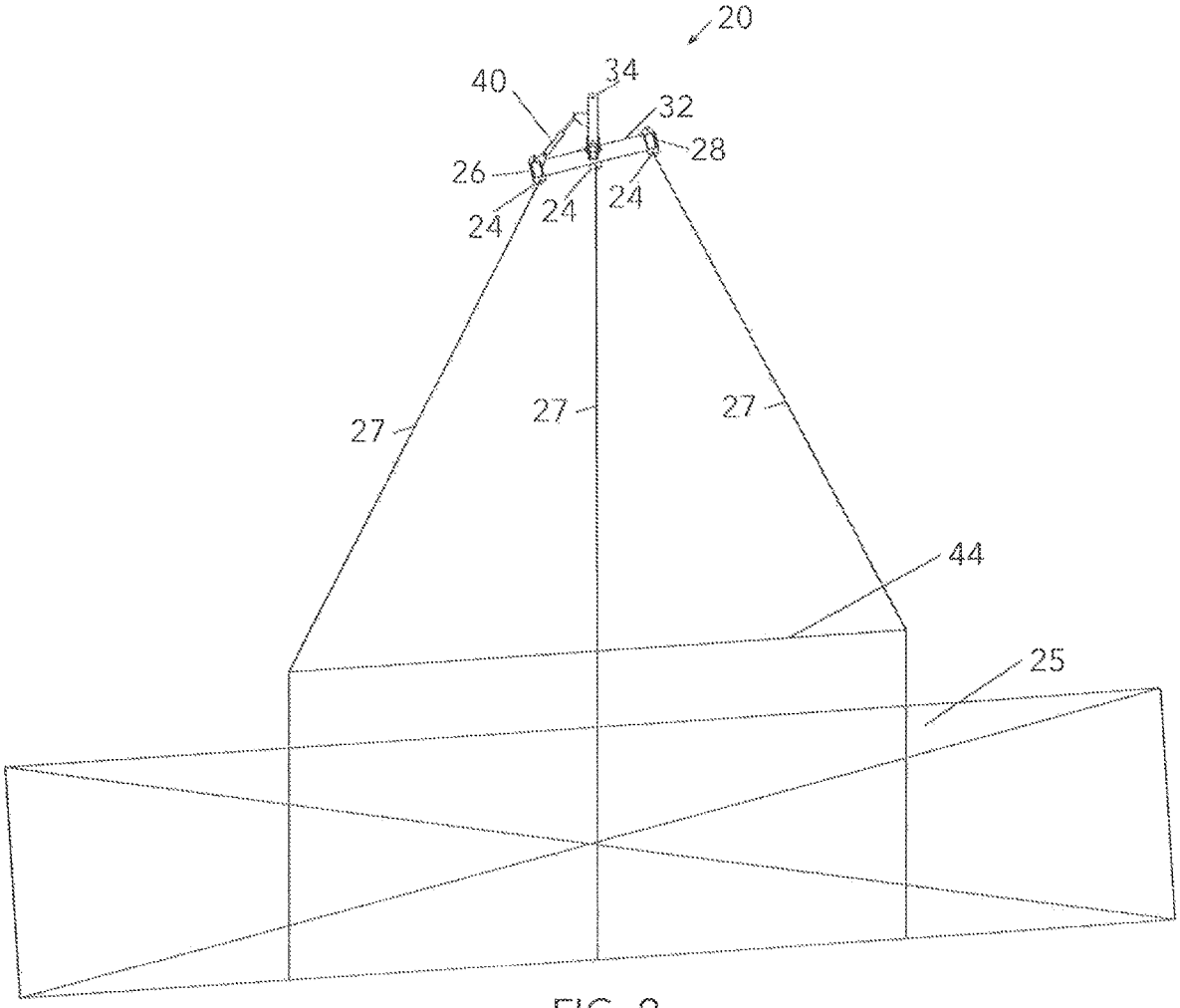
FIG. 9 is a second side elevation view of the apparatus of FIG. 1 with suspended load, with a forced pitched orientation.
Figure 10:
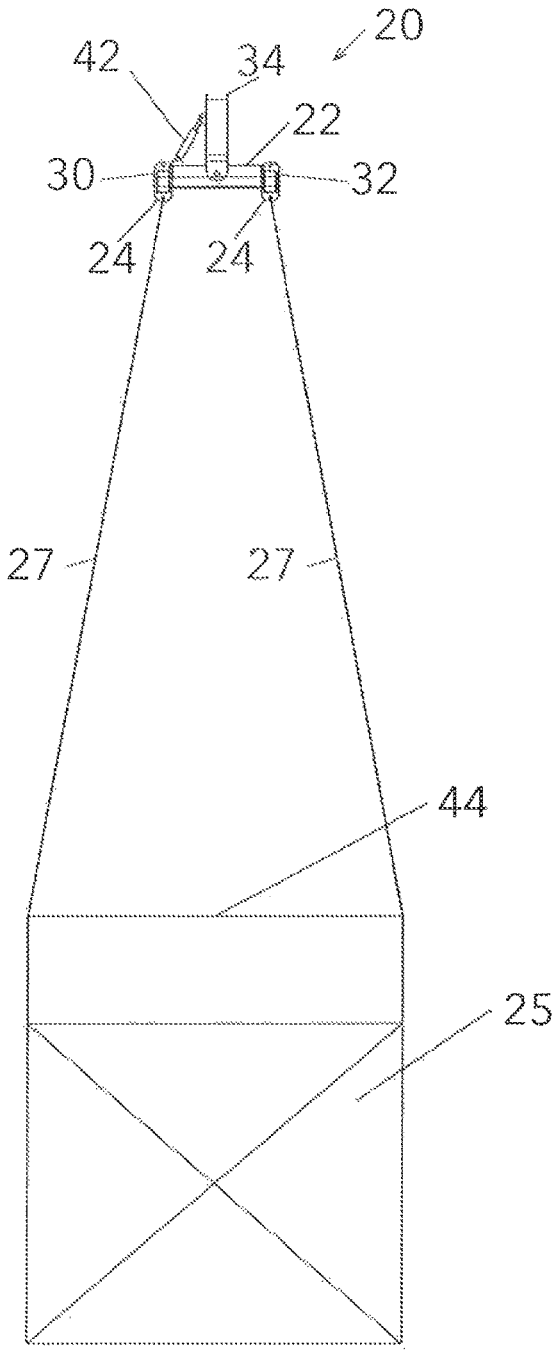
FIG. 10 is a first end elevation view of the apparatus of FIG. 1 with suspended load, in a neutral orientation.

In FIGS. 8 and 10, apparatus 20 is in a level orientation and so is load 25. It will be understood that some loads will not automatically assume a level and balanced orientation when suspended from cables 27. With such loads, an adjustment of apparatus 20 may be required to level load 25. It will also be understood, that sometimes an orientation other than level is desirable when setting load 25 down in position. Referring to FIG. 9, load 25 is shown as being intentionally pitched forward. Referring to FIG. 3, this is accomplished by expanding first actuator 40 to cause first end 26 to go down and second end 28 to go up. This is accomplished through a hydraulic control module (not shown), which causes hydraulic pump 21 (as illustrated in FIG. 1), to draw fluid from reservoir 23 into first actuator 40. It will be understood that adjustment of the orientation of frame 22 results in a like adjustment of cables 27 from which load 25 is suspended, lowering cables 27 attached to first end of frame 26 and raising cables attached to second end 28 of frame to give load 25 a pitched forward orientation.

Referring to FIG. 4, a similar but opposite effect can be achieved by contracting first actuator 40. In such a case, hydraulic control module (not shown) is used to cause hydraulic pump 21 (illustrated in FIG. 1) to draw fluid from first actuator 40 into reservoir 23. When first actuator 40 is contracted, first end 26 goes up and second end 28 goes down, which consequently raises cables 27 attached to first end 26 and lowers cables 27 attached to second end 28, resulting in load 25 being pitched in the opposite direction.

Figure 11:
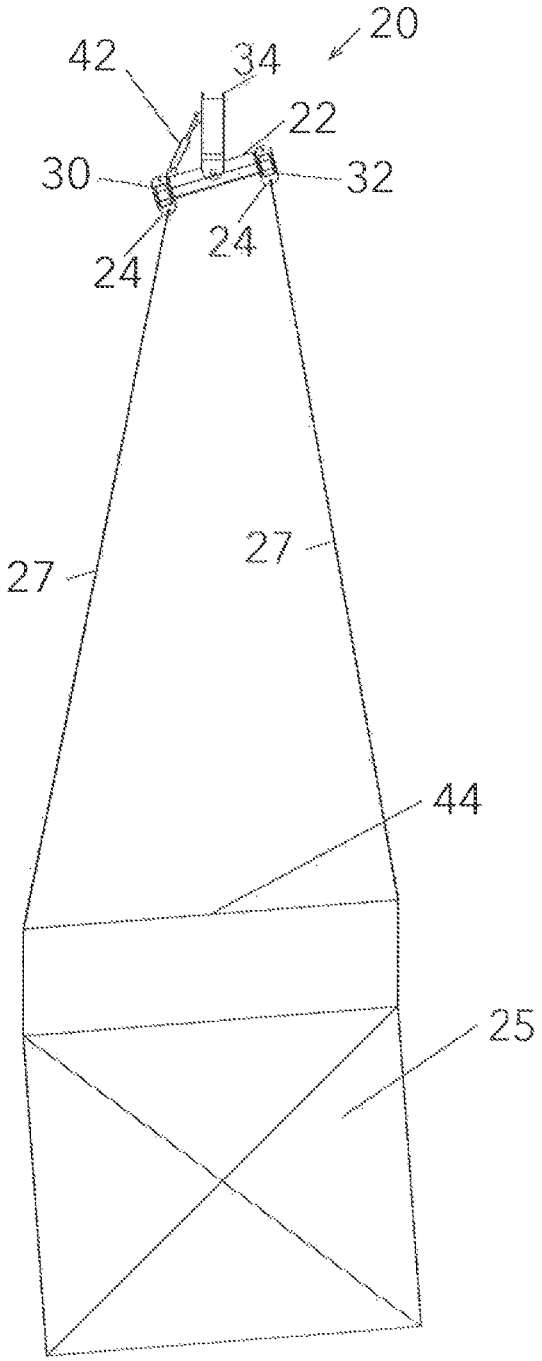
FIG. 11 is a second end elevation view of the apparatus of FIG. 1 with suspended load, with a forced rolled orientation.

Referring to FIG. 11, load is shown intentionally rolled. Referring to FIG. 6, this is accomplished by expanding second actuator 42. A hydraulic control module (not shown) is used to activate hydraulic pump 21 (shown in FIG. 1) causing hydraulic pump 21 to draw hydraulic fluid from reservoir 23 into second actuator 42. When second actuator 42 is expanded, first side 30 goes down and second side 32 goes up. Referring to FIG. 11, this movement of frame 22 raises cables 27 attached to second side 32 and lowers cables 27 to roll load 25 to one side.

Referring to FIG. 7, in order to contract second actuator 42, hydraulic pump 21 (shown in FIG. 1) draws hydraulic fluid from second actuator 42 into reservoir 23. When second actuator 42 is contracted, first side 30 goes up and second side 32 goes down. This results in cables 27 attached to first side 30 being raised and cables 27 attached to second side 32 being lowered to roll load 25 in the opposite direction.

First actuator 40 and second actuator 42 can both be expanded and contracted to various degrees to allow for various angles of tilt of frame 22 and consequently suspended load 25. Spreader bar 44 is attached to cables 27 to space cables 27 about load 25 as appropriate.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

The scope of the claims should not be limited by the illustrated embodiments set forth as examples, but should be given the broadest interpretation consistent with a purposive construction of the claims in view of the description as a whole.

What is claimed is:

1. An apparatus for adjusting an orientation of a suspended load, comprising:

a frame having a plurality of cable attachment points, whereby multiple cables from a suspended load are attached to the frame, the frame having a first end and a second end opposed to the first end, the frame having a first side and a second side opposed to the first side;

a suspension assembly from which the frame is suspended, the suspension assembly having a first pivot axis attachment to the frame enabling up and down pitching movement of the frame relative to the suspension assembly and a second pivot axis attachment to the frame enabling up and down rolling movement of the frame relative to the suspension assembly;

a first actuator extending between the suspension assembly and the frame to impart a pitching movement of the frame, the first actuator expanding and contracting, such that when the first actuator expands the first end goes down and the second end goes up, and when the first actuator contracts the first end goes up and the second end goes down; and a second actuator extending between the suspension and the frame to impart a rolling movement of the frame, the second actuator expanding and contracting, such that when the second actuator expands the first side goes down and the second side goes up, and when the second actuator contracts the first side goes up and the second side goes down.

2. The apparatus of claim 1, wherein the first actuator and the second actuator are fluid activated.

3. The apparatus of claim 1, wherein the frame is rectangular.

4. An apparatus for adjusting an orientation of a suspended load, comprising:

a rectangular frame having a plurality of cable attachment points, whereby multiple cables from a suspended load are attached to the frame, the frame having a first end and a second end opposed to the first end, the frame having a first side and a second side opposed to the first side;

a suspension assembly from which the frame is suspended, the suspension assembly having a first pivot axis attachment to the frame enabling up and down pitching movement of the frame relative to the suspension assembly and a second pivot axis attachment to the frame enabling up and down rolling movement of the frame relative to the suspension assembly;

a fluid activated first actuator extending between the suspension assembly and the frame to impart a pitching movement of the frame, the first actuator expanding and contracting, such that when the first actuator expands the first end goes down and the second end goes up, and when the first actuator contracts the first end goes up and the second end goes down; and a fluid activated second actuator extending between the suspension and the frame to impart a rolling movement of the frame, the second actuator expanding and contracting, such that when the second actuator expands the first side goes down and the second side goes up, and when the second actuator contracts the first side goes up and the second side goes down.

* * * * *